US006086171A

United States Patent [19]

Ashley et al.

[11] Patent Number: 6,086,171

[45] Date of Patent: Jul. 11, 2000

[54] CAROUSEL SHOE CABINET

[76] Inventors: Cynthia H. Ashley; John P. Ashley, both of 5183 Rush Dr., Montgomery, Ala. 36108

[21] Appl. No.: 09/247,978

[22] Filed: Feb. 11, 1999

[51] Int. Cl.[7] ..... A47F 1/00; A47F 7/00

[52] U.S. Cl. ..... 312/97.1; 312/135; 312/305; 211/34; 211/163; 211/205

[58] Field of Search ..... 312/305, 97.1, 312/125, 135, 197, 258, 319.7, 202; 211/196, 205, 163, 34

[56] References Cited

U.S. PATENT DOCUMENTS

| | | | |
|---|---|---|---|
| 353,419 | 11/1886 | Lamson | 312/135 |
| 492,304 | 2/1893 | Markle | 312/135 |
| 1,909,942 | 5/1933 | Fingerman | 206/278 |
| 2,326,064 | 8/1943 | Pittman | 211/163 X |
| 2,693,989 | 11/1954 | Santana et al. | 312/135 X |
| 3,331,513 | 7/1967 | Capelli | 211/34 |
| 3,512,859 | 5/1970 | Barroero | 312/125 X |
| 4,289,246 | 9/1981 | Scott | 211/205 |
| 4,838,625 | 6/1989 | Taylor | 312/305 X |
| 5,050,746 | 9/1991 | Frankel | 211/34 |
| 5,114,017 | 5/1992 | Doyel | 211/34 |
| 5,562,216 | 10/1996 | Falconio | 211/163 X |
| 5,813,547 | 9/1998 | Rice | 211/34 |
| 5,848,710 | 12/1998 | Pomper | 211/205 X |

FOREIGN PATENT DOCUMENTS

| | | | |
|---|---|---|---|
| 237803 | 8/1925 | United Kingdom | 312/135 |

*Primary Examiner*—Peter M. Cuomo
*Assistant Examiner*—James O. Hansen

[57] ABSTRACT

A carousel shoe cabinet for storing shoes in an organized manner. The carousel shoe cabinet includes a cabinet with an upper compartment therein. The front of the cabinet has an opening into the upper compartment. A carousel assembly is provided in upper compartment. The carousel assembly has generally circular spaced apart upper and lower rings, and an elongate shaft extending between the upper and lower rings. The upper and lower rings each have a center hub and plurality of radial spokes extending radially between the center hub and the respective ring. An upper end of the elongate shaft is coupled to the center hub of the upper ring. A lower end of the elongate shaft is rotatably mounted to the center hub of the lower ring to permit free rotation of the elongate shaft about the longitudinal axis of the elongate shaft. A plurality of hanger assemblies are hung on the upper ring. Each of the hanger assemblies has an upper hook and a column of interconnected flexible shoe sleeves downwardly depending from the upper hook. The upper hook of each of the hanger assemblies is hooked on the upper ring such that the column of shoe sleeves of each hanger assembly downwardly depends from the upper ring. Each of the shoe sleeves is designed for receiving a pair of shoes therein.

13 Claims, 3 Drawing Sheets

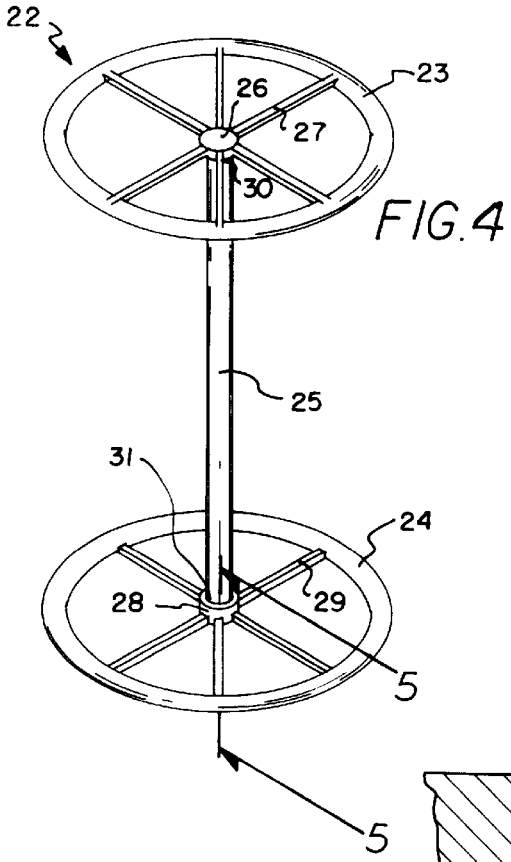
FIG. 4
FIG. 5
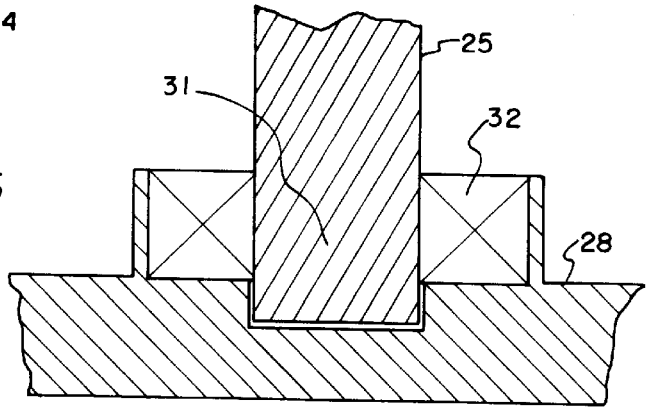
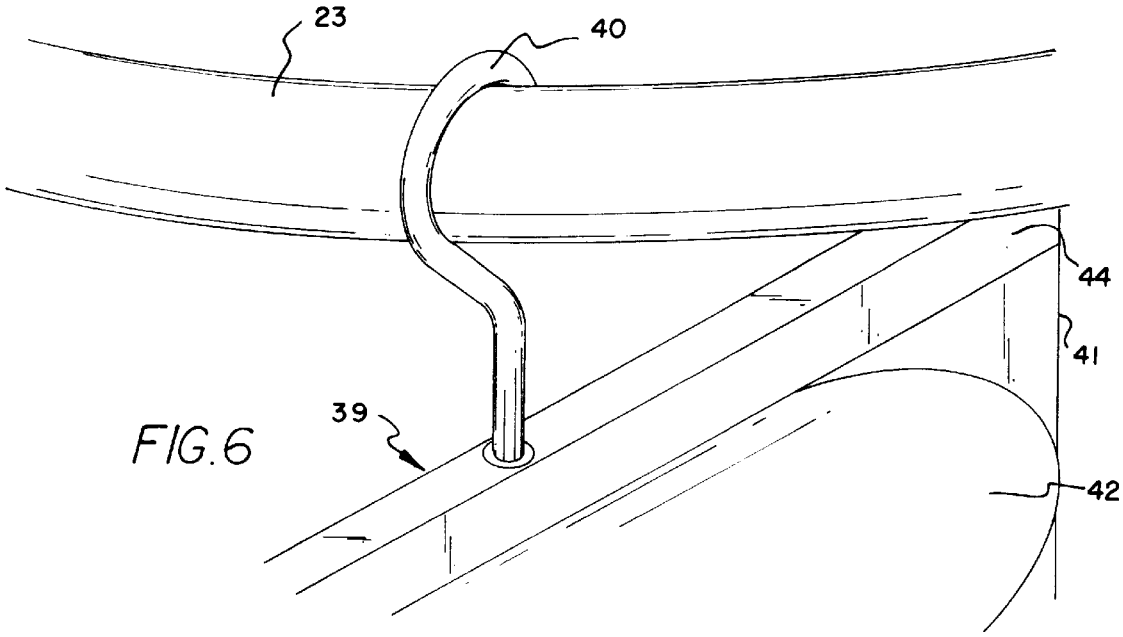
FIG. 6

CAROUSEL SHOE CABINET

BACKGROUND OF THE INVENTION

1. Field of the Invention

The present invention relates to shoe cabinets and more particularly pertains to a new carousel shoe cabinet for storing shoes in an organized manner.

2. Description of the Prior Art

The use of shoe cabinets is known in the prior art. More specifically, shoe cabinets heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,160,571; U.S. Pat. No. 3,331,513; U.S. Pat. No. Des. 314,874; U.S. Pat. No. 1,909,942; U.S. Pat. No. 3,563,390; and U.S. Pat. No. 5,114,017.

While these devices fulfill their respective, particular objectives and requirements, the aforementioned patents do not disclose a new carousel shoe cabinet. The inventive device includes a cabinet with an upper compartment therein. The front of the cabinet has an opening into the upper compartment. A carousel assembly is provided in upper compartment. The carousel assembly has generally circular spaced apart upper and lower rings, and an elongate shaft extending between the upper and lower rings. The upper and lower rings each have a center hub and plurality of radial spokes extending radially between the center hub and the respective ring. An upper end of the elongate shaft is coupled to the center hub of the upper ring. A lower end of the elongate shaft is rotatably mounted to the center hub of the lower ring to permit free rotation of the elongate shaft about the longitudinal axis of the elongate shaft. A plurality of hanger assemblies are hung on the upper ring. Each of the hanger assemblies has an upper hook and a column of interconnected flexible shoe sleeves downwardly depending from the upper hook. The upper hook of each of the hanger assemblies is hooked on the upper ring such that the column of shoe sleeves of each hanger assembly downwardly depends from the upper ring. Each of the shoe sleeves is designed for receiving a pair of shoes therein.

In these respects, the carousel shoe cabinet according to the present invention substantially departs from the conventional concepts and designs of the prior art, and in so doing provides an apparatus primarily developed for the purpose of storing shoes in an organized manner.

SUMMARY OF THE INVENTION

In view of the foregoing disadvantages inherent in the known types of shoe cabinets now present in the prior art, the present invention provides a new carousel shoe cabinet construction wherein the same can be utilized for storing shoes in an organized manner.

The general purpose of the present invention, which will be described subsequently in greater detail, is to provide a new carousel shoe cabinet apparatus and method which has many of the advantages of the shoe cabinets mentioned heretofore and many novel features that result in a new carousel shoe cabinet which is not anticipated, rendered obvious, suggested, or even implied by any of the prior art shoe cabinets, either alone or in any combination thereof.

To attain this, the present invention generally comprises a cabinet with an upper compartment therein. The front of the cabinet has an opening into the upper compartment. A carousel assembly is provided in upper compartment. The carousel assembly has generally circular spaced apart upper and lower rings, and an elongate shaft extending between the upper and lower rings. The upper and lower rings each have a center hub and plurality of radial spokes extending radially between the center hub and the respective ring. An upper end of the elongate shaft is coupled to the center hub of the upper ring. A lower end of the elongate shaft is rotatably mounted to the center hub of the lower ring to permit free rotation of the elongate shaft about the longitudinal axis of the elongate shaft. A plurality of hanger assemblies are hung on the upper ring. Each of the hanger assemblies has an upper hook and a column of interconnected flexible shoe sleeves downwardly depending from the upper hook. The upper hook of each of the hanger assemblies is hooked on the upper ring such that the column of shoe sleeves of each hanger assembly downwardly depends from the upper ring. Each of the shoe sleeves is designed for receiving a pair of shoes therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new carousel shoe cabinet apparatus and method which has many of the advantages of the shoe cabinets mentioned heretofore and many novel features that result in a new carousel shoe cabinet which is not anticipated, rendered obvious, suggested, or even implied by any of the prior art shoe cabinets, either alone or in any combination thereof.

It is another object of the present invention to provide a new carousel shoe cabinet which may be easily and efficiently manufactured and marketed.

It is a further object of the present invention to provide a new carousel shoe cabinet which is of a durable and reliable construction.

An even further object of the present invention is to provide a new carousel shoe cabinet which is susceptible of a low cost of manufacture with regard to both materials and labor, and which accordingly is then susceptible of low prices of sale to the consuming public, thereby making such carousel shoe cabinet economically available to the buying public.

Still yet another object of the present invention is to provide a new carousel shoe cabinet which provides in the apparatuses and methods of the prior art some of the advantages thereof, while simultaneously overcoming some of the disadvantages normally associated therewith.

Still another object of the present invention is to provide a new carousel shoe cabinet for storing shoes in an organized manner.

Yet another object of the present invention is to provide a new carousel shoe cabinet which includes a cabinet with an upper compartment therein. The front of the cabinet has an opening into the upper compartment. A carousel assembly is provided in upper compartment. The carousel assembly has generally circular spaced apart upper and lower rings, and an elongate shaft extending between the upper and lower rings. The upper and lower rings each have a center hub and plurality of radial spokes extending radially between the center hub and the respective ring. An upper end of the elongate shaft is coupled to the center hub of the upper ring. A lower end of the elongate shaft is rotatably mounted to the center hub of the lower ring to permit free rotation of the elongate shaft about the longitudinal axis of the elongate shaft. A plurality of hanger assemblies are hung on the upper ring. Each of the hanger assemblies has an upper hook and a column of interconnected flexible shoe sleeves downwardly depending from the upper hook. The upper hook of each of the hanger assemblies is hooked on the upper ring such that the column of shoe sleeves of each hanger assembly downwardly depends from the upper ring. Each of the shoe sleeves is designed for receiving a pair of shoes therein.

Still yet another object of the present invention is to provide a new carousel shoe cabinet that provides easy access to shoes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a schematic perspective view of the carousel assembly of the present invention.

FIG. 5 is a schematic cross sectional view of the lower end of the elongate shaft of the carousel assembly as seen from line 5—5 on FIG. 4.

FIG. 6 is a schematic perspective view of the present invention illustrating the hanging of a hook of a hanger assembly on the upper ring of the carousel assembly.

DESCRIPTION OF THE PREFERRED EMBODIMENT

Figure 1:
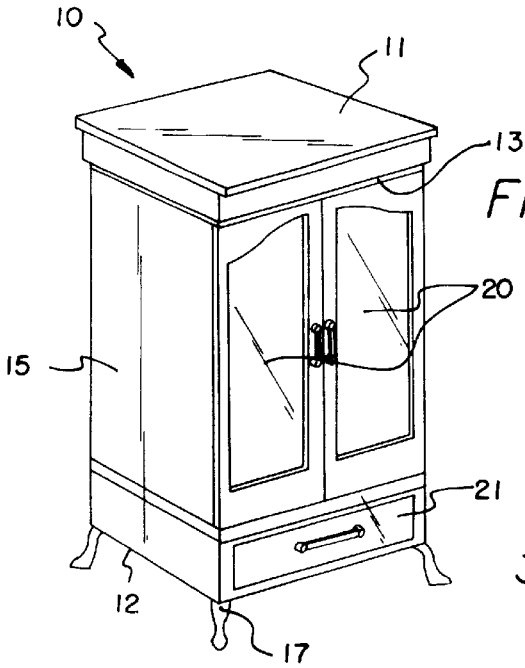
FIG. 1 is a schematic perspective view of a new carousel shoe cabinet with the doors closing the front opening into the upper compartment according to the present invention.
Figure 2:
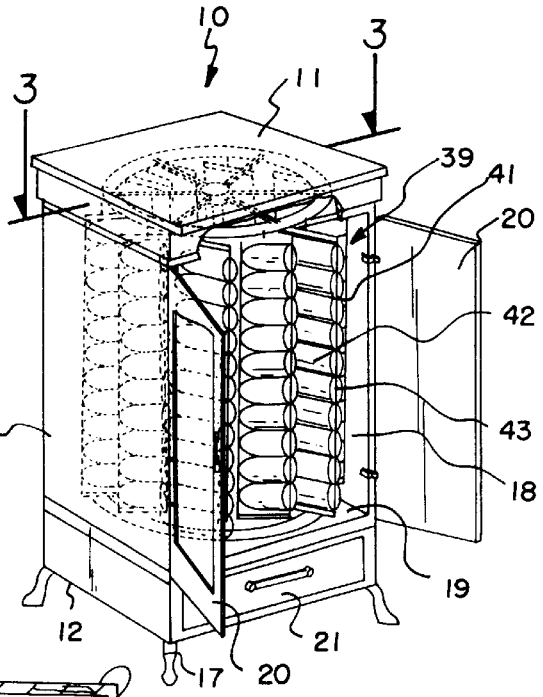
FIG. 2 is a schematic perspective view of the present invention with the doors open to reveal the carousel assembly and hanger assemblies in the upper compartment of the cabinet.
Figure 3:
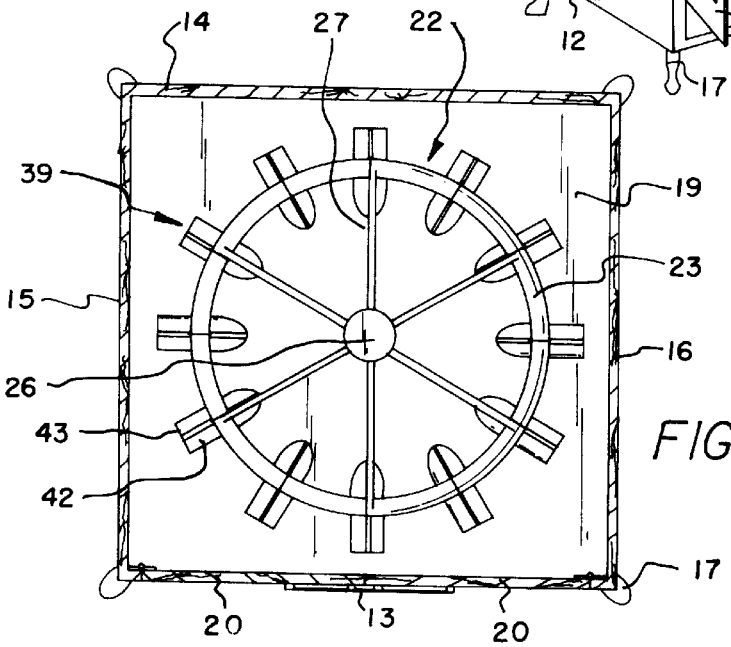
FIG. 3 is a schematic cross sectional view of the present invention taken from line 3—3 on FIG. 2 and looking downwards into the upper compartment.
Figure 7:
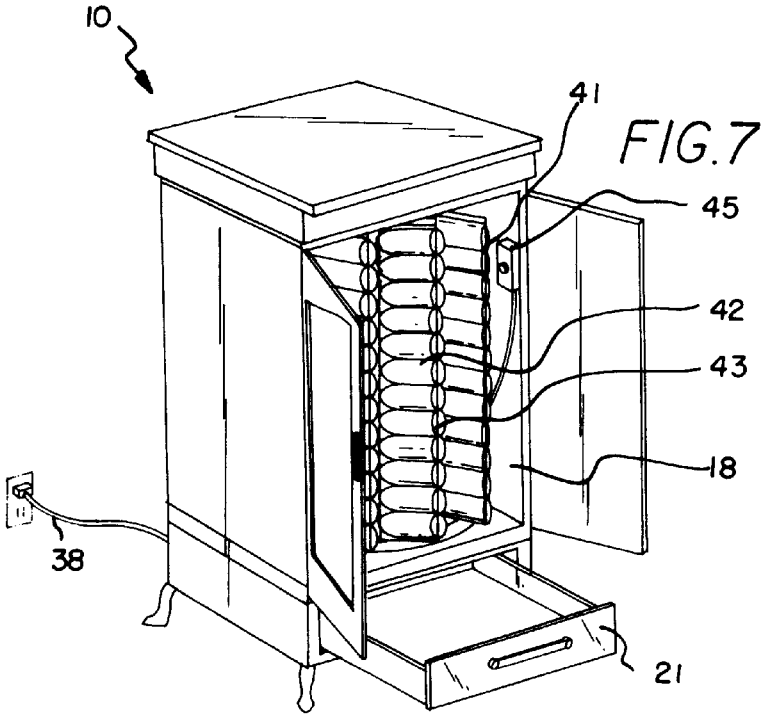
FIG. 7 is a schematic perspective view of the motorized embodiment of the present invention.

With reference now to the drawings, and in particular to FIGS. 1 through 8 thereof, a new carousel shoe cabinet embodying the principles and concepts of the present invention and generally designated by the reference numeral 10 will be described.

As best illustrated in FIGS. 1 through 8, the carousel shoe cabinet 10 generally comprises a cabinet 10 with an upper compartment 18 therein. The front 13 of the cabinet 10 has an opening into the upper compartment 18. A carousel assembly 22 is provided in upper compartment 18. The carousel assembly 22 has generally circular spaced apart upper and lower rings 23,24, and an elongate shaft 25 extending between the upper and lower rings 23,24. The upper and lower rings 23,24 each have a center hub 26,28 and plurality of radial spokes 27,29 extending radially between the center hub and the respective ring. An upper end 30 of the elongate shaft 25 is coupled to the center hub 26 of the upper ring 23. A lower end 31 of the elongate shaft 25 is rotatably mounted to the center hub 28 of the lower ring 24 to permit free rotation of the elongate shaft 25 about the longitudinal axis of the elongate shaft 25. A plurality of hanger assemblies 39 are hung on the upper ring 23. Each of the hanger assemblies 39 has an upper hook 40 and a column 41 of interconnected flexible shoe sleeves 42 downwardly depending from the upper hook 40. The upper hook 40 of each of the hanger assemblies 39 is hooked on the upper ring 23 such that the column 41 of shoe sleeves 42 of each hanger assembly 39 downwardly depends from the upper ring 23. Each of the shoe sleeves 42 is designed for receiving a pair of shoes therein.

In closer detail, the cabinet 10 (or wardrobe) has a top 11, a bottom 12, a front 13, a back 14, and a pair of sides 15,16. The top 11 and bottom 12 of the cabinet 10 each are preferably generally rectangular and has a plurality of corners. The bottom 12 of the cabinet 10 has a plurality of downwardly depending legs 17 for supporting the cabinet 10 on a resting surface such as a floor. In the preferred embodiment, each of the corners of the bottom 12 of the cabinet 10 has a leg 17 located thereadjacent.

Preferably, the top 11 and bottom 12 of the cabinet 10 generally lie in generally horizontal parallel planes to one another. In this preferred embodiment, the front 13 and back 14 of the cabinet 10 generally lie in generally vertical parallel planes to one another generally perpendicular to the planes of the top 11 and bottom 12 of the cabinet 10. Similarly, the sides 15,16 of the cabinet 10 generally lie in generally vertical parallel planes to one another generally perpendicular to the planes of the front 13 and back 14 of the cabinet 10 and generally perpendicular to the planes of the top 11 and bottom 12 of the cabinet 10. In an ideal illustrative embodiment, the cabinet 10 has a height defined between the top 11 and bottom 12 of the cabinet 10 of about 6 feet and a width defined between the sides 15,16 of the cabinet 10 of about 4 feet.

The cabinet 10 has an upper compartment 18 therein with the front 13 of the cabinet 10 have a generally rectangular opening into the upper compartment 18. The upper compartment 18 has a generally horizontal bottom shelf 19 defining the bottom of the upper compartment 18. The cabinet 10 preferably has a pair of doors 20 substantially closing the opening of the front 13 of the cabinet 10 into the upper compartment 18. One of the doors is pivotally coupled to the cabinet 10 adjacent one of the sides of the cabinet and the other door is pivotally coupled to the cabinet 10 adjacent the other side of the cabinet. Ideally, the front 13 of the cabinet 10 also has a lower drawer 21 for storing items therein. The lower drawer 21 is located between the upper compartment 18 and the bottom 12 of the cabinet 10.

The carousel assembly 22 is provided in upper compartment 18. The carousel assembly 22 has generally circular spaced apart upper and lower rings 23,24, and an elongate shaft 25 extending between the upper and lower rings 23,24. The lower ring 24 rests on the bottom shelf 19. Preferably, the upper and lower rings 23,24 each have a generally circular transverse cross section taken generally perpendicular to the circumference of the respective ring. The upper and lower rings 23,24 each have a center hub 26,28 and plurality of radial spokes 27,29 extending radially between the center hub and the respective ring to connect the center hub and ring together. The upper ring 23 and the associated center hub 26 and radial spokes 27 preferably generally lie in a common plane. Similarly, the lower ring 24 and the associated center hub 28 and radial spokes 29 generally lie in a common plane. Preferably, the upper and lower rings 23,24 generally lie in generally horizontal parallel planes to one another.

The elongate shaft 25 has upper and lower ends 30,31, and a longitudinal axis extending between the upper and lower ends 30,31 of the elongate shaft 25. The longitudinal axis of the elongate shaft 25 extends generally perpendicular to the planes of the upper and lower rings 23,24. The upper end 30 of the elongate shaft 25 is coupled to the center hub 26 of the upper ring 23. With reference to FIG. 5, the lower end 31 of the elongate shaft 25 is rotatably mounted to the center hub 28 of the lower ring 24 preferably by a bearing 32 in the center hub 28 of the lower ring 24 to permit free rotation of the elongate shaft 25 about the longitudinal axis of the elongate shaft 25 such that rotating of the elongate shaft 25 rotates the upper ring 23.

Figure 8:
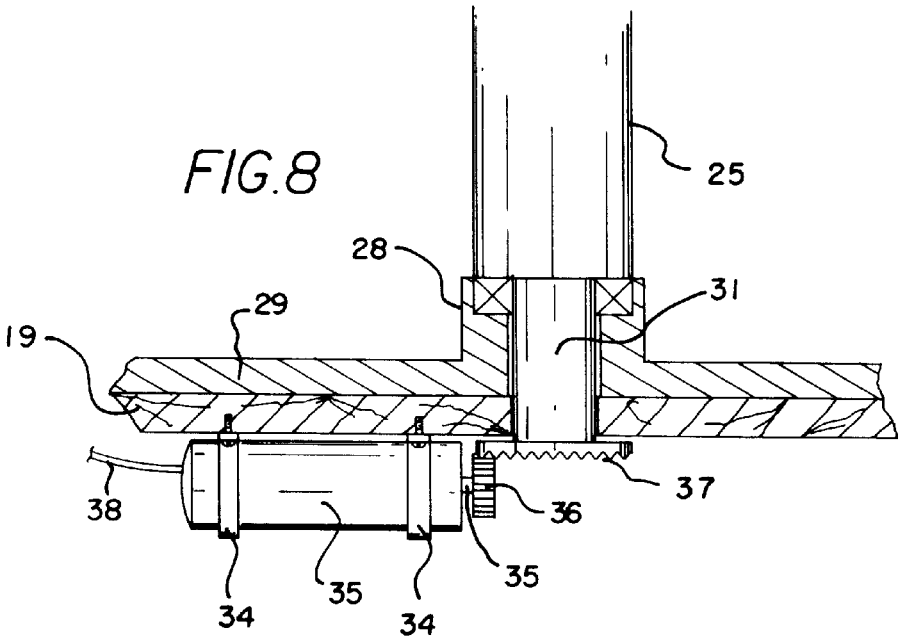
FIG. 8 is a schematic cross sectional view of the region around the lower end of the elongate shaft of the motorized embodiment of the of the present invention.

Optionally, as illustrated in FIG. 8, a motor 33 may be provided for rotating the elongate shaft 25 about the longitudinal axis of the elongate shaft 25. The motor 33 is positioned in the cabinet 10 beneath the bottom shelf 19 and has a switch 45 electrically connected thereto located in the upper compartment. The motor 33 is coupled to the bottom 12 of the bottom shelf 19 by mounting brackets 34. The motor 33 is electrically connectable to an electrical power receptacle by an elongate electrical cord 38 extending outwards from the cabinet 10. The motor 33 has a rotating shaft 35 terminating at a driving gear 36. In this optional embodiment, the lower end 31 of the elongate shaft 25 downwardly extends through the bottom shelf 19 and terminating at a driven gear 37. The driving gear 36 and the driven gear 37 engage one another such that rotation of the rotating shaft 35 by the motor 33 rotates the elongate shaft 25 about the longitudinal axis of the elongate shaft 25.

The plurality of hanger assemblies 39 are designed for suspending shoes from the upper ring 23. Each of the hanger assemblies 39 has an upper hook 40 and a column 41 of interconnected flexible shoe sleeves 42 downwardly depending from the upper hook 40. Preferably, each of the hanger assemblies 39 has an generally stiff upper crossbar 44 connecting the column 41 of shoe sleeves 42 to the upper hook 40. As illustrated in FIG. 6, the upper hook 40 of each of the hanger assemblies 39 is hooked on the upper ring 23 such that the column 41 of shoe sleeves 42 of each hanger assembly 39 downwardly depends from the upper ring 23.

Each of the shoe sleeves 42 is designed for receiving a pair of shoes therein. Each of the shoe sleeves 42 has a side opening 43 for inserting a pair of shoes therein. The shoe sleeves 42 is flexible to permit bending, folding, and collapsing of the column 41. Preferably, the shoe sleeves 42 are generally translucent (ideally transparent) to permit viewing of shoes stored therein. In an ideal embodiment, each column 41 of shoe sleeves 42 comprises ten shoe sleeves 42. The column 41 of shoe sleeves 42 of each hanger assembly 39 has a pair elongate vertical sides. The side openings 43 of the shoe sleeves 42 are located adjacent one of the vertical sides of the respective column 41 of shoe sleeves 42. Preferably, each hanger assembly is hung on the upper ring so that the side openings 43 of the shoe sleeves 42 face in a radially outwards direction from the longitudinal axis of the elongate shaft 25 so that the side openings are easily accessible to a user.

In use, a pair of shoes may be stored in each shoe sleeve. The user rotates the carousel assembly so that the shoe sleeve having the desired pair of shoes is positioned adjacent the front opening into the upper compartment so that the user may easily remove the shoes from the shoe sleeve.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A piece of furniture for storing shoes, comprising:

a cabinet having a front;

said cabinet having an upper compartment therein, said front of said cabinet having an opening into said upper compartment;

a carousel assembly being provided in upper compartment, said carousel assembly having generally circular spaced apart upper and lower rings, and an elongate shaft extending between said upper rings;

said upper and lower rings each having a center hub and plurality of radial spokes extending radially between said center hub and the respective ring;

said elongate shaft having upper and lower ends, and a longitudinal axis extending between said upper and lower ends of said elongate shaft;

said upper end of said elongate shaft being coupled to said center hub of said upper ring;

said lower end of said elongate shaft being rotatably mounted to said center hub of said lower ring to permit free rotation of said elongate shaft about said longitudinal axis of said elongate shaft;

a plurality of hanger assemblies, each of said hanger assemblies having an upper hook and a column of interconnected flexible shoe sleeves downwardly depending from said upper hook;

said upper hook of each of said hanger assemblies being hooked on said upper ring such that the column of shoe sleeves of each hanger assembly downwardly depends from said upper ring; and each of said shoe sleeves being adapted for receiving a pair of shoes therein.

2. The piece of furniture of claim 1, wherein said cabinet has a top, a bottom, a back, and a pair of sides, and wherein said bottom of said cabinet has a plurality of downwardly depending legs for supporting said cabinet on a resting surface.

3. The piece of furniture of claim 2, wherein said top and bottom of said cabinet each are generally rectangular and have a plurality of corners, each of said corners of said bottom of said cabinet having a legs located thereadjacent.

4. The piece of furniture of claim 2, wherein said top and bottom of said cabinet generally lie in generally parallel planes to one another, said front and back of said cabinet generally lie in generally parallel planes to one another generally perpendicular to said planes of said top and bottom of said cabinet, and wherein said sides of said cabinet generally lie in generally parallel planes to one another generally perpendicular to said planes of said front and back of said cabinet and generally perpendicular to said planes of said top and bottom of said cabinet.

5. The piece of furniture of claim 1, wherein said cabinet has a pair of doors substantially closing said opening of said front of said cabinet into said upper compartment, one of said doors being pivotally coupled to said cabinet adjacent a first side of said cabinet, another of said doors being pivotally coupled to said cabinet adjacent a second side of said cabinet.

6. The piece of furniture of claim 1, wherein said front of said cabinet has a lower drawer, said lower drawer being located below said upper compartment.

7. The piece of furniture of claim 1, wherein said upper ring and the associated center hub and radial spokes generally lie in a common plane, and said lower ring and the associated center hub and radial spokes generally lie in a common plane, wherein said upper and lower rings generally lie in generally parallel planes to one another.

8. The piece of furniture of claim 1, wherein said upper compartment has a bottom shelf, said lower ring being rested on said bottom shelf, wherein a motor is provided for rotating said elongate shaft about said longitudinal axis of said elongate shaft, said motor being positioned provided in said cabinet beneath said bottom shelf, said motor having a rotating shaft terminating at a driving gear, said lower end of said elongate shaft being downwardly extend through said bottom shelf and terminating at a driven gear, said driving gear and said driven gear engaging one another such that rotation of said rotating shaft by said motor rotates said elongate shaft about said longitudinal axis of said elongate shaft.

9. The piece of furniture of claim 1, wherein each of said hanger assemblies has an upper crossbar connecting said column of shoe sleeves to said upper hook.

10. The piece of furniture of claim 1, wherein each column of shoe sleeves comprises ten shoe sleeves.

11. The piece of furniture of claim 1, wherein each of said shoe sleeves having a side opening for inserting a pair of shoes therein.

12. The piece of furniture of claim 11, wherein said column of shoe sleeves of each hanger assembly has a pair elongate vertical sides, said side openings of said shoe sleeves being located adjacent one of said vertical sides of the respective column of shoe sleeves, said side openings of said shoe sleeves facing in a radially outwards direction from said longitudinal axis of said elongate shaft.

13. A piece of furniture for storing shoes, comprising:

a cabinet having a top, a bottom, a front, a back, and a pair of sides;

said top and bottom of said cabinet each being generally rectangular and having a plurality of corners;

said bottom of said cabinet having a plurality of downwardly depending legs for supporting said cabinet on a resting surface;

each of said corners of said bottom of said cabinet having a legs located thereadjacent;

said top and bottom of said cabinet generally lying in generally parallel planes to one another;

said front and back of said cabinet generally lying in generally parallel planes to one another generally perpendicular to said planes of said top and bottom of said cabinet;

said sides of said cabinet generally lying in generally parallel planes to one another generally perpendicular to said planes of said front and back of said cabinet and generally perpendicular to said planes of said top and bottom of said cabinet;

said cabinet having an upper compartment therein, said front of said cabinet having a generally rectangular opening into said upper compartment, said upper compartment having a bottom shelf;

said cabinet having a pair of doors substantially closing said opening of said front of said cabinet into said upper compartment, one of said doors being pivotally coupled to said cabinet adjacent one of said sides of said cabinet, another of said doors being pivotally coupled to said cabinet adjacent another of said sides of said cabinet;

said front of said cabinet having a lower drawer, said lower drawer being located between said upper compartment and said bottom of said cabinet;

a carousel assembly being provided in upper compartment, said carousel assembly having generally circular spaced apart upper and lower rings, and an elongate shaft extending between said upper rings;

said lower ring being rested on said bottom shelf;

said upper and lower rings each having a generally circular transverse cross section;

said upper and lower rings each having a center hub and plurality of radial spokes extending radially between said center hub and the respective ring to connect the center hub and ring together;

said upper ring and the associated center hub and radial spokes generally lying in a common plane, said lower ring and the associated center hub and radial spokes generally lying in a common plane;

said upper and lower rings generally lying in generally parallel planes to one another;

said elongate shaft having upper and lower ends, and a longitudinal axis extending between said upper and lower ends of said elongate shaft;

said longitudinal axis of said elongate shaft extending generally perpendicular to said planes of said upper and lower rings;

said upper end of said elongate shaft being coupled to said center hub of said upper ring;

said lower end of said elongate shaft being rotatably mounted to said center hub of said lower ring to permit free rotation of said elongate shaft about said longitudinal axis of said elongate shaft;

a motor for rotating said elongate shaft about said longitudinal axis of said elongate shaft, said motor being positioned provided in said cabinet beneath said bottom shelf, said motor being coupled to said bottom shelf;

said motor having a rotating shaft terminating at a driving gear;

said lower end of said elongate shaft being downwardly extend through said bottom shelf and terminating at a driven gear;

said driving gear and said driven gear engaging one another such that rotation of said rotating shaft by said motor rotates said elongate shaft about said longitudinal axis of said elongate shaft;

a plurality of hanger assemblies, each of said hanger assemblies having an upper hook and a column of interconnected flexible shoe sleeves downwardly depending from said upper hook, wherein each of said hanger assemblies has an upper crossbar connecting said column of shoe sleeves to said upper hook;

said upper hook of each of said hanger assemblies being hooked on said upper ring such that the column of shoe sleeves of each hanger assembly downwardly depends from said upper ring;

wherein each column of shoe sleeves comprises ten shoe sleeves;

each of said shoe sleeves being adapted for receiving a pair of shoes therein, each of said shoe sleeves having a side opening for inserting a pair of shoes therein;

wherein said shoe sleeves are generally translucent to permit viewing of shoes stored therein;

said column of shoe sleeves of each hanger assembly having a pair elongate vertical sides, said side openings of said shoe sleeves being located adjacent one of said vertical sides of the respective column of shoe sleeves; and said side openings of said shoe sleeves facing in a radially outwards direction from said longitudinal axis of said elongate shaft.

* * * * *